United States Patent [19]

Masuda et al.

[11] 4,027,049

[45] May 31, 1977

[54] PROCESS FOR ELECTROSTATIC DIRECT TRANSFER PRINTING OF DESIGNS ON FABRICS

[75] Inventors: Yougoro Masuda, Takatsuki; Takashi Sato, Settsu; Shigeru Kawase, Hirakata, all of Japan

[73] Assignee: Kanebo, Ltd., Tokyo, Japan

[22] Filed: Aug. 14, 1975

[21] Appl. No.: 604,865

[30] Foreign Application Priority Data

Aug. 26, 1974 Japan ..... 49-98189

[52] U.S. Cl. ..... 427/19; 427/24

[51] Int. Cl.[2] ..... B05D 1/28; B05D 3/14

[58] Field of Search ..... 427/19, 24

[56] References Cited

UNITED STATES PATENTS 3,928,669 12/1975 Takahashi ..... 427/19

FOREIGN PATENTS OR APPLICATIONS 1,017,593 1/1966 United Kingdom ..... 427/19

*Primary Examiner*—James R. Hoffman

*Attorney, Agent, or Firm*—Sughrue, Rothwell, Mion, Zinn & Macpeak

[57] ABSTRACT

A process of electrostatically printing a design on fabrics which comprises forming an electrostatic latent image corresponding to the design on a photoconductive material or an insulating dielectric material, developing the latent image with a toner comprising at least one chargeable resin and at least one colorant, transferring the developed toner image directly to a fabric having a surface inherent resistivity, as measured at a temperature of 20° C and a relative humidity of 65%, of about $1 \times 10^6$ to about $1 \times 10^{14}$ ohms, and fixing the toner image to the fabric. When the transferring of the toner image is carried out using a corona discharge, a smooth sheet having a volume inherent resistivity of about $1 \times 10^6$ to about $1 \times 10^{20}$ ohms and a dielectric constant of about 2 to about 40 can be overlaid on the fabric to apply corona discharge through the sheet and thereby produce better results.

29 Claims, 1 Drawing Figure

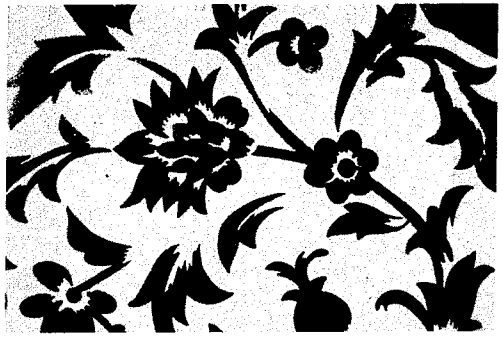

PROCESS FOR ELECTROSTATIC DIRECT TRANSFER PRINTING OF DESIGNS ON FABRICS

BACKGROUND OF THE INVENTION

1. Field of the Invention

This invention relates to a process for direct transfer printing of designs on fabrics using electrostatic printing techniques. More specifically, it relates to an improved process for electrostatic direct transfer printing of a design on a fabric wherein the fabric has a surface inherent resistivity, as measured at a temperature of 20° C and a relative humidity of 65% of the fabric to about $1 \times 10^6$ to about $1 \times 10^{14}$ ohms. The invention also relates to an improved process for electrostatic direct transfer printing of a design on a fabric wherein the transfer is performed by corona discharge while a sheet having a volume inherent resistivity of $1 \times 10^6$ to $1 \times 10^{20}$ ohms is superimposed on that surface of the fabric which is opposite the surface to be imprinted.

2. Description of the Prior Art

Transfer printing methods using an electrostatic photographic technique, usually called electrostatic printing, include, for example, a xerographic method and an electrofax method. For example, the xerographic method comprises forming a positive electrostatic latent image on an amorphous selenium photosensitive layer, developing the latent image with a negatively charged colored powder (to be referred to hereinafter as a "toner") composed of a colorant such as a dye or pigment and a resin capable of being charged, superimposing a paper sheet on the developed image, and applying a corona discharge to the paper sheet thereby to transfer the toner image on the photosensitive layer to the paper sheet. The electrofax method involves using zinc oxide as a photosensitive layer, developing a latent image formed on it with a positively charged toner, and then transferring the developed toner image to a paper sheet using a negative corona dischage.

When paper sheets are used as a material to be imprinted in the above-described methods, corona discharge transfer of the developed images on the photosensitive layer to paper can be performed satisfactorily to obtain electrostatically transferred printed images having a high density and sharpness, and in fact, these methods have been widely used commercially. However, where fabrics are used as a material to be imprinted, electrostatic transfer printing provides extremely poor results. Therefore, methods using fabrics have scarcely been practiced commercially, or have had to include complicated steps. The serious difficulty in this case lies in the transfer of the developed toner image to the fabric. Because the efficiency of transfer in this case is very poor, feasible image densities and sharpness cannot be obtained. The contamination of the back of the printed fabrics is also high, and degrades the commercial value of the printed goods. With a view to avoiding these difficulties, it has been the previous practice to transfer the developed toner image first to a paper sheet, and then transfer it to a fabric by heating under pressure. Or when a sublimable dye is used as the colorant, a transfer sheet having a developed toner image thereon is superimposed on a fabric and heated under pressure to sublime and transfer only the dye to the fabric. These complicated steps naturally add to the cost of production as a result of the loss of the dye, etc. Furthermore, since one additional step is required for transfer, the image ultimately transferred tends to be vague and poor in quality. Further, contamination of the back surface of the fabrics with the toner which passes through the openings in the structure of the fabrics (hereinafter back side contamination) occurs with this technique. These difficulties preclude the use of the electrostatic printing process in printing of designs on fabrics.

SUMMARY OF THE INVENTION

It is, therefore, an object of this invention to provide a process for the direct electrostatic transfer of a toner image developed on a photosensitive layer directly to fabrics to form clear printed images with a high density.

Another object of this invention is to provide a process for electrostatic transfer printing of a toner image developed on a photosensitive layer directly to fabrics without causing a back side contamination.

Still another object of this invention is to provide a process for electrostatic transfer printing of a toner image developed on a photosensitive layer directly to a fabric wherein the transfer is performed using corona discharge while a sheet having a specific volume inherent resistivity is superimposed on that surface of the fabric which is opposite the surface to be imprinted.

A further object of this invention is to provide a process for electrostatic transfer printing in which back side contamination does not occur.

According to this invention, there is provided a process for electrostatically printing a design on fabrics which comprises forming an electrostatic latent image corresponding to the design on a photoconductive material or an insulating dielectric material, developing the latent image with a toner comprising a chargeable resin and a colorant, electrostatically transferring the developed toner image directly to a fabric, and fixing the toner image to the fabric; wherein the surface inherent resistivity of the fabric measured at a temperature of 20° C and a relative humidity of 65% is about $1 \times 10^6$ to about $1 \times 10^{14}$ ohms.

BRIEF DESCRIPTION OF THE DRAWING

The FIGURE comprises a photograph of a resulting printed fabric obtained in accordance with an embodiment of the process of this invention as described in an example hereinafter, the left half of the figure corresponding to the process of this invention and the right half of the FIGURE corresponding to a comparison process.

DETAILED DESCRIPTION OF THE INVENTION

The latent image can be an electrostatic latent image formed on a photoconductive layer of an inorganic or organic photoconductive substance such as selenium, zinc oxide, cadmium sulfide or polyvinyl carbazole used in an electrostatic photographic method such as a xerographic method, e.g., as disclosed in U.S. Pat. No. 2,618,552, and electrofax method, e.g., as disclosed in U.S. Pat. No. 2,874,063, or a modification of these methods, an electrostatic latent image transferred to an insulating dielectric material such as polyethylene, polystyrene or a methacrylic resin in a TESI method, or a charge pattern produced by an electrostatic recording method using such an insulating dielectric material. The electrostatic latent image is developed with a toner using known methods such as a magnet brush method (for example, as disclosed in U.S. Pat. No. 2,874,063), a cascade method (for example, as disclosed in U.S.

Pat. No. 2,618,552), or a powder cloud method (for example, as disclosed in U.S. Pat. No. 2,918,900).

The process of this invention will be described below with special reference to the electrofax method.

A photosensitive paper having a photosensitive layer of zinc oxide as a photoconductive substance is uniformly charged negatively in the dark using a negative corona discharge, and then exposed to light through a black and white film bearing a design. As a result, the charge in the exposed area disappears, whereas the charge in the unexposed area remains. Thus a charge distributed image corresponding to the original design is formed. In this case, a negative electrostatic latent image is obtained. The latent image is then developed with a toner comprising a colorant and a resin capable of being charged, which in this case is charged positively.

Suitable chargeable resins include those which can be charged positively or negatively by a triboelectric effect or corona discharge. Examples of suitable resins are homopolymers of ethylene, propylene, styrene, aminostyrene, a methacrylic acid ester such as methyl methacrylate or butyl methacrylate, vinyl chloride, or vinyl acetate, copolymers of these monomers with each other or with other polymerizable monomers, polycarbonate, ethyl cellulose, and polyvinyl formal. Suitable examples of other monomers copolymerizable therewith include glycidyl ethers, vinyl propionate, butadiene, acrylonitrile, acrylic acid, methacrylic acid and the like. Of these, styrene polymers or copolymers, methacrylate polymers or copolymers, polycarbonates, and modified products of these polymers are especially preferred since these resins are hard and have excellent electrostatic properties. Of these polymers, those having a low molecular weight (a low degree of polymerization) are particularly preferred since they are hard and, in addition, tend to melt easily. When water-soluble resins are preferred from the standpoint of an easy resin removal, with a convenient water-washer polyacrylamide and polyvinyl alcohol can also be used.

The colorant used with these resins can be any known dyes or pigments. Examples of suitable colorants include disperse dyes such as Sumikalon Violet RL (a tradename for a product of Sumitomo Chemical Co., Ltd.), Dianix Red FS (a tradename for a product of Mitsubishi Chemical Co., Ltd.) and Miketon Polyester Red FB (a tradename for a product of Mitsui Toatsu Chemicals, Inc.); acid dyes such as Suminol Fast Orange RG (a tradename for a product of Sumitomo Chemical Co., Ltd), Acid Violet 5B (a tradename for a product of Mitsui Toatsu Chemicals, Inc.) and Kayaku Acid Red 3B (a tradename for a product of Nippon Kayaku Co., Ltd.); basic dyes such as Sumiacryl Orange G (a tradename for a product of Sumitomo Chemical Co., Ltd.), Diacryl Supla Red R (a tradename for a product of Mitsubishi Chemical Co., Ltd.) and Aisenkatilon Black GH (a tradename for a product of Hodogaya Chemical Co., Ltd); direct dyes such as Diacotton Violet X (a tradename for a product of Mitsubishi Chemical Co., Ltd.), Direct Blue 2B (a tradename for a product of Sumitomo Chemical Co., Ltd.) and Direct Fast Black AB (a tradename for a product of Mitsubishi Chemical Co., Ltd.); reactive dyes such as Procion Brilliant Blue H7GS (a tradename for a product of Imperial Chemical Industries, Limited), Diamira Black B (a tradename for a product of Mitsubishi Chemical Co., Ltd.) and Cibacron Brilliant Red B-D (a tradename for a product of Ciba, Limited); white pigments such as titanium white and zinc flower (zinc oxide); and black pigments such as carbon black and aniline black.

Toners can be prepared using any known methods. For example, the resin and the colorant can be dissolved or dispersed in a solvent such as dioxane, trichloroethylene, dimethylformamide or benzene, and the resulting solution or dispersion can be added to a non-solvent for the resin and the colorant to precipitate the colored resin, which is dried and pulverized. Alternatively, such a solution or dispersion can be spray dried, or gelled at low temperatures and then pulverized and dried, or melted and pulverized.

A charge controlling agent such as a fatty acid (e.g., oleic acid) can be added during the preparation of the toners. If desired, the toner can be classified by, for example, a fluid separating method to adjust the toner particle diameter to not more than about 80 microns, preferably to not more than about 30 microns, prior to use.

Development of the latent image with such a toner can be accomplished using known methods such as a magnet brush method, a cascade method or a powder cloud method. The toner must be charged when used to develop the latent image. When the magnet brush method is used, the toner and iron powder are mixed, and stirred to charge the toner by friction. Where the cascade method is used, the toner is mixed with a glass powder or sand and stirred to charge the toner by friction. Whether the toner is charged positively or negatively in these methods depends upon the resin used in the toner, but this can be easily determined by triboelectric series or experiment. For example, in the case of the magnet brush method, methyl methacrylate and aminostyrene resins are charged positively, and polystyrene and a copolymer of styrene and 2-hydroxyethyl methacrylate are negatively charged. In the case of the powder cloud method, the charging caused by the triboelectric effect and development are performed simultaneously.

Thus, an image developed with the toner and corresponding to the original design is formed on the photosensitive layer of the photosensitive paper. Even if a xerographic method is employed in which positively chargeable selenium is used as a photoconductive material instead of the electrofax method illustrated above, a developed image can be obtained using similar steps with the polarities of toner charging and corona discharge being reversed. Irrespective of which method is used, the process of this invention can be carried out effectively.

A modification of these methods can also be used which, for example, comprises coating a photoconductive material such as CdS, CdSe, ZnO or Se on a conductive support such as aluminum or copper, laminating an insulating resin film such as a polyester, polyamide, fluorocarbon resin or polyolefin resin film on the coating of the photoconductive substance thereby to form a photosensitive layer, subjecting the photosensitive layer to a corona discharge to uniformly charge the insulating film, preferably positively (when the photoconductive substance is an N-type photoconductive material) or preferably negatively (when the photoconductive material is a P-type photoconductive substance), exposing the photosensitive layer imagewise through an original image and simultaneously subjecting the layer to an alternate current corona discharge or a corona discharge having an opposite polarity to the above charging, and then uniformly exposing the entire surface to form an electrostatic latent image having a high contrast on the insulating resin film, and then developing the latent image using a method known publicly (a simultaneous charging and exposing method).

If desired, before development, the latent image on the photosensitive layer can be transferred onto a dielectric film such as a polyethylene or polystyrene film by a TESI method (transfer of electrostatic images), and developed there. Alternatively, toner images can also be formed by an electrostatic recording method using such an insulating dielectric film wherein a recording medium having an insulating dielectric layer is interposed between two electrodes one of which is grounded, and a positive or negative voltage is applied to the recording medium to form an electrostatic latent image directly on the surface of the recording medium, and the latent image is then developed by a similar method to those described above.

The toner image so developed is finally transferred to a fabric to be imprinted.

Suitable fabrics which can be used in the method of this invention include woven, knitted or non-woven fabrics of natural fibers such as cotton, silk or wool, semi-synthetic fibers such as viscose (cellulose xanthate) or cellulose acetate or synthetic fibers such as polyester, polyacrylonitrile and polyamide fibers, either individually or in admixture with each other. Suitable fabric forms include broad cloth, muslin, satin cloth, twill cloth, taffeta, tricot, jersey and the like. In order to transfer the toner image onto the fabric, the fabric is overlaid on the developed photosensitive surface, and a corona discharge having an opposite polarity to that of the developed toner and the same polarity as the charge on the photosensitive layer is applied.

A very important characteristic of the process of this invention is that the fabric to be imprinted has a surface inherent resistivity, measured at a temperature of 20° C and a relative humidity of 65%, of about $1 \times 10^6$ to $1 \times 10^{14}$ ohms. This ensures a good transfer of the developed toner image directly to the fabric.

In order to adjust the surface inherent resistivity of the fabric to the above-specified range, the fabric can be treated with a water-soluble polymer, a nonionic surface active agent, an anionic surface active agent, a cationic surface active agent, an amphoteric surface active agent, a polymeric electrolyte or an inorganic material.

Examples of suitable water-soluble polymers are carboxymethyl cellulose, hydroxyethyl cellulose, polyvinyl alcohol, polyvinyl pyrrolidone, polyacrylamide, and polyethylene oxide.

Examples of suitable nonionic surfactants are alkylphenol ether-type surfactants such as polyoxyethylene nonylphenol ether or polyoxyethylene octylphenol ether (for example, Noniolight PN-4, a product of Kyoei-Sha; Nonion NS-206, a product of Nippon Oils and Fats Co., Ltd.), higher alcohol ether-type surfactants such as polyoxyethylene lauryl ether or polyoxyethylene oleyl ether (for example, Noniolight AO-5, a product of Kao Atlas Company; Nonion K-215, a product of Nippon Oils and Fats Co., Ltd.), higher fatty acid sorbitan ester-type surfactants such as sorbitan monooleate, sorbitan distearate or polyoxyethylene sorbitan monooleate (for example, Nonion OP-80R, a product of Nippon Oils and Fats Co., Ltd.; Noniolight SPO, a product of Kyoei-Sha); higher fatty acid pentaerythritol ester-type surfactants such as pentaerythritol monostearate (for example, Noniolight MSM, a product of Kyoei-Sha), higher fatty acid trimethylol propane ester-type surfactants such as trimethylol propane monooleate (for example, Noniolight POM, a product of Kyoei-Sha), higher fatty acid polyethylene glycol ester-type surfactants such as polyethylene glycol monooleate or polyethylene glycol distearate (for example, Emanon 3199, a product of Kao Atlas Company; Nonion O-6, Nippon Oils and Fats Co., Ltd.), and nitrogen-containing surfactants such as polyoxyethylene lauryl amine ether (for example, Noniolight NL-10, a product of Kyoei-Sha).

Examples of suitable anionic surfactants are higher alcohol sulfuric acid ester salts such as lauryl sulfate sodium salt (for example, Emal O, a product of Kao Atlas Company), and alkylbenzene sulfonic acid salts such as sodium dodecylbenzenesulfonate (for example, Neopelex No. 6, a product of Kao Atlas Company).

Examples of suitable cationic surfactants are polyoxyethylene alkylamines such as polyoxyethylene stearylamine (for example, Amit 308, a product of Kao Atlas Company), and quaternary ammonium salts such as octadecyl trimethyl ammonium chloride (for example, Kation AB, a product of Nippon Oils and Fats Co., Ltd.).

Examples of suitable amphoteric surfactants are betainetype surfactants such as lauryl dimethyl betaine, or amino acidtype surfactants such as sodium lauryl aminopropionate.

Examples of suitable polymeric electrolytes are polyacrylic acid, polystyrenesulfonic acid, polyvinylsulfonic acid, polyphosphoric acid, polyvinylamine, polyethyleneimine, nucleic acids such as pentose nucleic acid and deoxypentose nucleic acid, alginic acid.

Examples of suitable inorganic materials are alkali metal salts such as sodium chloride, lithium chloride, or potassium chloride, sodium sulfate, potassium nitrate, alkali metal hydroxides such as sodium hydroxide, potassium hydroxide or lithium hydroxide, alkali metal carbonates such as sodium carbonate or sodium bicarbonate, alkaline earth metal salts such as magnesium chloride, calcium chloride or barium chloride, alkaline earth metal oxides such as calcium oxide or magnesium oxide, or metal powders such as aluminum or copper powders.

Of these treating agents, carboxymethyl cellulose, hydroxyethyl cellulose, polyethylene oxide, nonionic surfactants of the ether and ester types, polyacrylic acid, the sodium salt of polyacrylic acid, polyalginic acid, and the sodium salt of polyalginic acid are especially preferred.

The above materials can be used individually or as admixtures with each other. Preferred combinations are a mixture of a nonionic surface active agent and a polymeric electrolyte, and a mixture of a water-soluble polymer and a polymeric electrolyte. A most preferred combination is a mixture of a nonionic surface active agent of the polyoxyethylene alkyl ether or polyoxyethylene alkylphenol ether-type and a water-soluble polymer such as carboxymethyl cellulose. Such a combination of materials which does not have any polarity exhibits a very superior effect probably because they do not impair the charging of the toner or electrostatic latent image. In the case of a combination of a polymeric electrolyte and a nonionic surfactant or a water-soluble polymer, good results are obtained when the proportion of the polymeric electrolyte is about 50 to 90 weight parts, and that of the nonionic surfactant or water-soluble polymer is about 10 to 50 weight parts; in the case of a combination of the nonionic surfactant and the water-soluble polymer, good results are obtained when the proportion of the nonionic surfactant is about 50 to 90 weight parts, and that of the water-soluble polymer is about 10 to 50 weight parts.

Treatment of the fabric with the above treating agent involves dissolving or dispersing the treating agent in a suitable liquid medium such as water, trichloroethylene, tetrachloroethylene, benzene, acetone or methanol, dipping the fabric in the resulting solution or dispersion, squeezing the fabric using a mangle to a suitable weight pick-up, and then drying the fabric in the air or at a suitable temperature and for a suitable period of time. A suitable dispersed or dissolved amount of the above treating agent is generally about 0.05 to 30%, preferably 0.1 to 20%, most preferably 0.2 to 5%.

Any drying temperature can be used so long as the drying treatment does not adversely affect the fabrics to be treated, i.e., below about 200°C. The time required for the drying varies depending upon the temperature used, but, in general, is about 2 to 15 minutes at a temperature of 60° to 150°C when water is used as a solvent or about 2 to 10 minutes at a temperature of 40°to 120°C when trichloroethylene is used as a solvent. Trichloroethylene and tetrachloroethylene are preferred because they are not inflammable and readily vaporizable. Alternatively, the above solution or dispersion can be applied to the fabric by spraying or coating, etc. and then the fabric dried.

The amount (pick-up) of the treating agent to be adhered to the fabric is that sufficient to adjust the surface inherent resistivity of the fabric to about $1 \times 10^6$ to $1 \times 10^{14}$ ohms, and such will vary according to factors such as the type and properties of the treating agent, or the type or thickness of the fabric to be treated and also according to the corona discharge voltage or the atmospheric conditions at the time of electrostatic transfer. Generally, when the amount of the treating agent added on the fabrics is 0.1% by weight based on the weight of the fabric (hereinafter the amount referred to the add-on amount), the surface inherent resistivity of the fabric becomes about $10^{11}$ to $10^{13}$ ohms, and this brings about an appreciable increase in the electrostatic transfer ratio of the toner. If the treatment of the fabrics is directed only to the prevention of back side contamination the add-on amount of the treating agent can be about 0.05% since this renders the resistivity about $10^{12}$ to $10^{14}$ ohms. As the pick-up is increased, the effect of increasing the electrostatic transfer efficiency, preventing back side contamination, increasing the color density of the dye, providing a sharp edge for the images and reducing fog becomes greater. Sufficiently feasible effects can be obtained with an add-on amount of up to about 5%. An add-on amount beyond about 5% do not produce improved results. For example, the result is almost the same whether the add-on amount is about 20% or about 5%. Accordingly, the add-on amount of the treating agent is about 0.01 to 20%, preferably 0.1 to 5%, more preferably 0.2 to 1%. In this case, the surface inherent resistivity of the fabric generally becomes about $10^8$ to $10^{11}$ ohms, and good results can be obtained.

When the fabric is made of synthetic fibers such as polyester, polyacrylonitrile or polyamide fibers or semi-synthetic fibers such as viscose or cellulose acetate fibers, the surface inherent resistivity of the fabric can be adjusted by incorporating the treating agent into a spinning solution or during polymerization in preparing the fibers that make up the fabric. In this case, the amount of the treating agent incorporated is about 0.2 to 25%, usually 0.5 to 3% by weight.

The discharge conditions at the time of electrostatic transfer using a corona discharge (for example, as described in U.S. Pat. No. 2,576,047) vary according to whether the form of electrodes is a dot-like form, a linear form a network form or a combination of these forms, the adoption of electrostaticity control, the thickness of the electrode wire, or the separation distance between electrodes, etc. Generally, however, the voltage is about 3,000 to 10,000 V, and the time is not more than about 20 seconds, usually less than 5 to 6 seconds. Whether a positive discharge or a negative discharge is to be used is determined by the method of discharge used, and in any case, a discharge having an opposite polarity to the charge of the toner is used.

As methods for electrostatic transfer, a bias roller method in which an electrically conductive roller with a suitable voltage applied thereto is rolled over the back surface of a fabric while the fabric is overlaid on the developed photosensitive layer, thereby to transfer the toner, can also be used. In this alternative method, the voltage applied to the roller is generally about 300 to 1500 V, and the contact time is generally less than 5 to 6 seconds. The voltage applied to the roller has an opposite polarity to the charge of the toner to be transferred. In some cases, it is sufficient simply to ground the roller.

A very advantageous effect of using the bias roll method is that the transfer ratio further increases since the roller is pressed against the fabric. This pressure varies according to the material, texture or thickness of the fabric, and if the pressure is too high, creases in the folding fabric occur. Accordingly, a preferred pressure is about 0.02 to 1 kg/cm$^2$ , generally 0.05 to 0.5 Kg/cm$^2$.

In carrying out the process of this invention, it is desirable to control the ambient humidity at the time of electrostatic transfer. Since the surface inherent resistivity of fabrics increases, in general, in an atmosphere having a low humidity, the effect of the process of this invention in reduced. Therefore, better results can be obtained in a higher humidity atmosphere. In the present invention, therefore, the relative humidity of the atmosphere at the time of electrostatic transfer is at least about 30%, preferably from 50% to 85–90%. When the relative humidity exceeds 90%, the ratio of transfer tends to decrease.

Needless to say, good results can also be obtained in a low humidity atmosphere depending upon the material of the fabric or the type and amount of the treating agent applied.

The fabric to which the toner image has been tranferred in the manner described above can be treated with heat, or a vapor of a solvent or by other suitable means to fix the toner. If desired, the color development of the dye can be performed with dry heat, steam or by applying suitable dyeing techniques depending on the respective dyes, or the resin is removed by washing with a solvent, before using the printed fabric as a final product.

Examples of suitable solvents which can be used for the treatment of the fabric and for removing the resin as described above are trichloroethylene, tetrachloroethylene, benzene, toluene, acetone, methyl ethyl ketone and the like which are particularly suitable for hydrophobic resins such as polystyrenes, polycarbonates, poly (methyl methacrylate), etc., and water which is particularly suitable for polyvinyl acetates, poly (ethyl cellulose), etc. It is preferred that the dispersible dyes are fixed by applying heat and direct dyes are fixed with steam.

When a sublimable dye is used as the colorant the fixing of the dye can be performed simply by heating. Since according to the process of this invention the toner adheres to the fabric directly, very sharp prints can be obtained unlike the situation with conventional methods which involve subliming the dye from a treansfer paper and fixing the dye onto the fabric. In the above-described methods, a multi-color print can be obtained if toners with colorants of different colors are transferred to the fabric one by one.

The printed fabrics obtained by the process of this invention exhibit a surprisingly good transfer ratio of the toner image as compared with conventional processes, and images having a quite high density not obtainable hitherto can be formed. Furthermore, sharp prints can be obtained, and even a minute design can be printed clearly. According to conventional processes, the transfer ratio (defined hereinbelow) is about 60% at the most, but in the process of this invention, the tranfer ratio increases to about 80 to 90%.

Thus, the process of this invention has made it possible for the first time to transfer toner images directly to fabrics on a commercial scale, and its commercial utilitarian value is high. Since direct transfer is possible in the process of this invention, no intermediate transfer paper is required, and the procedure is simple. The cost of production can also be reduced considerably. In addition, no treatment is required to regenerate the transfer paper. Since images of high density can be obtained, the amounts of the dye or the toner resin can be reduced. Another advantage is that since only the toner is transferred, the photosensitive layer can be repeatedly used. This also brings about great economical advantages.

Still another advantage of using the process of this invention is that fogging of non-image areas, which is called white background contamination, and contamination of multicolor images with each other can be greatly reduced. If a fabric is directly overlaid on the developed surface of a photosensitive layer and the toner image is transferred to the fabric, discharge occurs inevitably when the fabric is separated from the photosensitive layer after transfer. This is due to the charging of the fabric, and finally leads to a scattering of the toner. Thus, even when a good quality toner image is formed at the time of development, fogging or the disturbance of images occurs at the time of separating the transfer paper from the fabric. In contrast, according to the process of this invention, since the surface inherent resistivity of the fabric is relatively low, the fabric is no longer charged at the time of separation although at the time of electrostatic transfer, it is instantaneously charged by the corona discharge, attracts the toner and thus causes the toner to be transferred onto the fabric. Accordingly, no discharge occurs at the time of separating the photoconductive layer from the fabric, and therefore, no fog or disturbance of the images occurs.

Furthermore, when electrostatic transfer is carried out on the untreated fabrics using conventional processes, the toner reaches the back surface of the fabric through spaces between the weave or mesh of the fabric, diffuses there, and contaminates the back surface of the fabric to a considerable extent. Thus, even if images of good quality can be printed on the surface of the fabric, the contamination of the back surface alone renders the printed fabric almost valueless. However, according to the process of this invention, scarcely no back surface contamination occurs, and with woven and knitted fabrics of ordinary densities, almost no problems arise for commercial purposes. The absence of back surface contamination also means that the toner is substantially completely shielded by the fabric at the time of electrostatic transfer, and therefore, corona discharge electodes for transfer printing are also prevented from being contaminated by the toner.

Additionally, in the case of fabrics treated with surfactants, the diffusion of a dye into the interior of the fibers is exellent when transferring and fixing the toner and developing and fixing the color of the dye using a method such as dry heating or steaming. This results in prints of high color density and depth, and renders the printed fabrics very valuable commercially.

According to another aspect of this invention, an improved embodiment of the process for the direct electrostatic transfer printing of a design on a fabric is provieded wherein the transfer is performed by corona discharge while a smooth sheet having a volume inherent resistivity of about $1 \times 10^6$ to about $1 \times 10^{20}$ ohms is superimposed on the back surface of the fabric to be imprinted.

When corona discharge is employed in electrostatic transfer, this additional embodiment of the process can be used together with the basic embodiment of the process in accordance with this invention described in detail so far. This brings about still better results.

Examples of smooth sheets used in this embodiment of the process of this invention include, for instance, various paper sheets, modifed paper sheet products obtained by impregnating them with a thermoplastic resin or a thermosetting resin, waterproofed or moisture-proofed paper sheet products, films or sheets composed of polyethylene, polypropylene, polyamides, polyesters, polyvinyl chloride, polyvinylidene chloride, natural and synthetic rubbers, polystyrene, polyvinyl alcohol, or polyvinyl acetal, synthetic paper-like webs or non-woven fabrics composed of fibers of these polymers and rubbers, and films and non-woven fabrics of viscose. The surfaces of these sheets are smooth. The term 'smooth', as used herein, is a relative term and means that the sheets are smooth as compared with the fabrics, and thus the term can even include what might in fact be considered a rough surface but is a smooth surface in comparison with fabrics.

The sheets used in this embodiment comprise an insulating dielectric material which has a dielectric constant of about 2 to about 50, and usually 2 to 20, and a volume inherent resistivity of about $10^6$ to about $10^{20}$ ohms, preferably $10^9$ to $10^{17}$ ohms. As will be described below, the sheet acts as a kind of a dielectric electrode, and if the dielectric constant and the volume inherent resistivity are outside the ranges specified above, good results cannot be obtained.

The thickness of the sheet is not particularly restricted, but generally, the sheet is preferably as thin as possible. Usually, a suitable thickness is about 10 microns to 5 mm. If the thickness is less than about 10 microns, for example, 5 microns, similar results can be obtained. However, except for stretched films of polyesters, polyamides and polystyrene, a thickness of less than about 10 microns is too small, and the operation becomes inconvenient. On the other hand, if the thickness of the sheet exceeds about 5 mm, the result becomes somewhat less satisfactory. Usually, a preferred thickness is 20 microns to 2 mm.

The smooth sheet can be positioned in proximity to the back surface of a fabric to be imprinted. Preferably, the sheet is placed in contact with that surface. Accordingly, with a cellulosic sheet, this sheet can be formed on that surface of a fabric which is opposite the surface to be imprinted using paper-making techniques. In the case of a resin film or sheet, the sheet can be formed by coating from a solution and then drying, or by heat extrusion lamination, on that surface. Such sheets can be removed after transfer printing, by peeling, washing or other suitable means.

According to the second embodiment of the invention, the sheet as described above is placed on the back surface of a fabric to be imprinted, and corona discharge is applied to the fabric through this sheet to transfer a toner image directly to the fabric and thereby to obtain sharp prints with superior density.

According to conventional processes, direct electrostatic transfer of a toner image to a fabric results in prints of faint color and lack of sharpness and this procedured is therefore not feasible. This is because the structure of the fabrics is extremely non-uniform and rough and have many large interspaces as compared with paper. Accordingly the action of corona discharge is so weak and non-uniform that it cannot effectively attract the toner on the photosensitive layer, and during discharge, the charge of the toner on the photosensitve layer is directly and non-uniformly neutralized through the interspaces of the fabric and the ability of the toner to be attracted is decreased.

In contrast, when corona discharge is applied in accordance with the process of this invention through the smooth sheet placed on the back surface of the fabric to be imprinted, the sheet retains an electric charge and the sheet acts as if it were a secondary electrode. Since this electrode approaches the fabric to be imprinted, the intensity of the electric field acting on the toner image increases, which in turn results in an increased attractive force and an increased ratio of the toner transferred. Furthermore, since the sheet is structurally uniform and its surface is smooth, as compared with the fabrics, the distribution of the electric charge is also uniform, and the toner on the photosensitve layer can be attracted uniformly. This appears to be the reason why sharp prints of deep color can be obtained by electrostatic transfer in accordance with this embodiment of the process. In addition, ion charges generated by corona discharge are sufficiently shielded by the sheet, and the charge of the sheet itself increases. Thus, the charge of the toner on the photosensitive layer is not directly neutralized through the coarse texture of the fabric. This, coupled with the above action, contributes to an increase in the toner attracting force, and as a result, sharp prints with a deep color can be obtained. Additional advantages are that the loss of the electric charge generated by corona discharge is reduced, the electrode can be placed nearer the fabric, and the consumption of power can be reduced.

When imprinting fabrics, the stretching, contraction and distortion of the fabrics always pose a problem, moreover, it is generally difficult to imprint fabrics with good precision. However, by superimposing the sheet, in accordance with this embodiment of the invention, on the back surface of a fabric, deformation of the fabric can be minimized. Even in the case of readily deformable materials such as a knitted fabric, deformation of the fabric can be completely prevented if a procedure is taken to coat a pressure-sensitive adhesive of a rubber-type or acrylic- type on the sheet and bond the adhesive to the fabric. Thus, even in the case of a multicolor printing, patterns can be precisely registered.

In performing the second embodiment of this invention, the same conditions as described in detail with regard to the first aspect can be employed with the same processing steps being involved. The following Examples are give to illustrate the present invention in greater detail.

All parts, ratios, percents and the like given in these Examples are by weight unless otherwise indicated.

The various evaluation methods used are described below:

A. Surface Inherent Resistivity

Measured in accordance with a method following JIS K-6911 in an atmosphere held at 20°C and 65% RH using a vibrating reed electrometer (Model TR-84M, a product of Takeda Riken).

B. Transfer Ratio (%)

The transfer ratio was calculated from the following equation.

$$\text{Transfer Ratio (\%)} = \frac{\text{Weight of Photosensitive Paper after Development} - \text{Weight of Photosensitive Paper after Transfer}}{\text{Weight of Photosensitive Paper after Development} - \text{Weight of Photosensitive Paper Before Development}} \times 100$$

C. Visual Evaluation of Fabric Back Surface Contamination

This was evaluated visually using a panel of 10 judges on a scale of 1 to 5. The result obtained was an average of evaluations by the 10 judges.

| Grade | Criterion |
|---|---|
| 1: | Heavily contaminated |
| 2: | Contaminated |
| 3: | Slightly contaminated |
| 4: | Almost no contamination |
| 5: | No contamination at all |

D. Visual Evaluation of Fog

The evaluation was made on a scale of 1 to 5 by the same method as in (C) above.

| Grade | Criterion |
|---|---|
| 1: | Considerable fog |
| 2: | Fairly heavy fog |
| 3: | Slight fog |
| 4: | Almost no fog |
| 5: | No fog at all |

E. Visual Evaluation of Color Development

The evaluation was made on a scale of 1 to 5 by the same method as in (C) above.

| Grade | Criterion |
|---|---|
| 1: | Very low density |
| 2: | Low density |
| 3: | Moderate density but without depth |
| 4: | High density with depth |
| 5: | Very high density with depth |

F. Visual Evaluation of the Edge of the Printed Pattern

The evaluation was made on a scale of 1 to 5 by the same method as in (C) above.

| Grade | Criterion |
|---|---|
| 1: | Edge very obscure |
| 2: | Edge pretty obscure |
| 3: | Edge slightly obscure |
| 4: | Edge clear |
| 5: | Edge very clear |

G. Volume Inherent Resistivity

Measured in accordance with DIN 53482 using a vibrating reed electrometer (Model TR-84M, a product of Takeda Riken).

H. Dielectric Constant

Measured in accordance with the method of DLN 53483 using a dielectric loss tester (Model R TRS-1OT, a product of Ando Denki).

EXAMPLE 1

A photosensitive paper with a zinc oxide photoconductive layer was uniformly charged negatively with a corona discharge of 7000 V in the dark, and exposed through a black and white film with a flower design image to form a corresponding electrostatic latent image on the photosensitive paper.

Separately, 180 parts of amino-modified polystyrene obtained by reacting a copolymer of styrene and glycidyl methacrylate with diethylamine was dissolved in 1000 parts of methyl ethyl ketone, and 50 parts of Sumikalon Violet RL (a disperse dye, tradename for a product of Sumitomo Chemical Co., Ltd.) was added. They were uniformly dissolved and dispersed thoroughly. The dispersion was poured into a large quantity of water with stirring, and the particles dried and sieved to obtain a powdery toner having an average particle size of about 15 microns. Then, 3 parts of the toner was well mixed with 97 parts of iron powder with stirring. Using the mixture, the above latent image was developed using a magnet brush method.

A polyester satin fabric having a thickness of about 0.5 mm was dipped in a 0.5% aqueous solution of each of the various nonionic surfactants shown in Table 1, in after fully impregnating the cloth with the solution, the cloth was squeezed with a mangle at a squeeze ratio of 100%. The treated satin was dried in a dryer at 100°C for 10 minutes.

The cloth so treated was then overlaid on the surface of the developed photosensitive paper, and a corona discharge of −7000 V was applied to the assembly from the back surface of the fabric thereby to transfer the toner image on the photosensitive paper to the polyester satin.

The toner transfer ratio and the fabric back surface contamination are shown in Table 1.

The polyester satin fabric to which the toner had been transferred was exposed to trichloroethylene vapor for about 10 seconds to fix the toner to the cloth, heated for 15 seconds in a drier at 200°C to develop the color of the dye, and then washed with trichloroethylene to remove the resin component.

The color development, sharpness of the printed pattern edge and fog of cloths imprinted with the flower design were determined, and the results obtained are shown in Table 1.

For comparison, the above procedure was repeated except that the polyester satin fabric was not treated with the surfactant. The results obtained are also shown in Table 1. The transfer of the toner was performed in an atmosphere kept at about 20°C and an RH of 65%.

Table 1

| Run No. | Nonionic Surfactant | Surface Inherent Resistivity | Transfer Ratio | Fabric Back Surface Contamination | Color Development | Edge of Printed Pattern | Fog |
|---|---|---|---|---|---|---|---|
| | | (ohms) | (%) | | | | |
| 1 | Polyoxyethylene nonylphenol ether (5 mols of ethylene oxide) | $2 \times 10^{10}$ | 84 | 4.5 | 4.3 | 4.2 | 4.3 |
| 2 | Polyoxyethylene lauryl ether (6 mols of ethylene oxide) | $1 \times 10^{11}$ | 80 | 4.3 | 4.1 | 4.3 | 4.2 |
| 3 | Sorbitan distearate | $5 \times 10^{10}$ | 83 | 4.4 | 4.0 | 4.2 | 4.3 |
| 4 | Pentaerythritol monostearate | $9 \times 10^{10}$ | 84 | 4.4 | 4.1 | 4.2 | 4.1 |
| 5 | Trimethylol propane monooleate | $5 \times 10^{11}$ | 83 | 4.3 | 4.0 | 4.2 | 4.2 |
| 6 | Polyethylene glycol distearate | $1 \times 10^{10}$ | 84 | 4.5 | 4.4 | 4.3 | 4.3 |
| 7 (Comparison) | None | $5 \times 10^{16}$ | 47 | 2.4 | 2.1 | 2.5 | 2.6 |

It can be seen from the results in Table 1 that when the fabric was treated to adjust its surface inherent resistivity to the specified range, very good results could be obtained with respect to the toner transfer ratio, fabric back surface contamination, the density of color, the edge of the printed pattern and fog.

EXAMPLE 2

140 parts of the same resin as used in Example 1 and 40 parts of Suminol Fast Orange RG (an acid dye, tradename for a product of Sumitomo Chemical Co., Ltd.) were dissolved and dispersed in 1,000 parts of methyl ethyl ketone. The dispersion was spray dried, and the particles sieved to obtain a powdery toner having an average particle size of about 10 to 20 microns.

One the other hand, a photosensitive paper with a zinc oxide photoconductive layer was uniformly charged negatively with a corona discharge of −5000 V, and exposed through a black and white film bearing an image of a circular spot-like design to form a latent image which was then developed with the toner prepared above.

A nylon fabric with a thickness of about 0.3 mm was treated with each of the various treating agents shown in Table 2 in the same way as in Example 1 , except the use of 3% of aqueous solution, so that the add-on amount became 3%. The treated nylon fabric was overlaid on the developed surface of the photosensitve paper, and a corona discharge of −6000 V was applied from the back side of the fabric to transfer the toner to the fabric. The toner transfer ratio and the fabric back surface contamination were determined. The results obtained are shown in Table 2. Furthermore, the fabric to which the toner had been transferred was heated for about 5 seconds with an infrared lamp to fix the toner onto the fabric, and then the fabric was steamed at 120°C for 30 minutes to develop the color of the dye and fix the dye to the fabric, followed by washing with trichloroethylene to remove the resin.

The color development, the edge of the printed pattern and fog of the fabrics were determined, and the results obtained are shown in Table 2. The transfer of the toner was performed in an atmosphere having a temperature of 25°C and a relative humidity of 80%.

Table 2

| Run No. | Treating Agent | Surface Inherent Resistivity | Transfer Ratio | Fabric Back Surface Contamination | Color Development | Edge of Printed Pattern | Fog |
|---|---|---|---|---|---|---|---|
| | | (ohms) | (%) | | | | |
| 1 | Octadecyl trimethyl ammonium chloride (cationic surfactant) | $5 \times 10^6$ | 82 | 4.4 | 4.2 | 4.1 | 4.0 |
| 2 | Sodium dodecylbenzenesulfonate (anionic surfactant) | $6 \times 10^8$ | 83 | 4.3 | 4.3 | 4.1 | 4.3 |
| 3 | Sodium lauryl-aminopropionate (amphoteric surfactant) | $3 \times 10^8$ | 86 | 4.6 | 4.5 | 4.2 | 4.5 |
| 4 | Sorbitan monooleate (non-ionic surfactant) | $1 \times 10^9$ | 83 | 4.5 | 4.3 | 4.3 | 4.2 |
| 5 | Hydroxyethyl cellulose | $1 \times 10^8$ | 84 | 4.6 | 4.3 | 4.2 | 4.4 |
| 6 | Glycerin | $7 \times 10^{12}$ | 80 | 4.4 | 4.1 | 4.1 | 4.2 |
| 7 | Polyethylene glycol | $6 \times 10^{12}$ | 81 | 4.3 | 4.1 | 4.0 | 4.3 |
| 8 | Sodium chloride | $5 \times 10^{13}$ | 80 | 4.2 | 4.1 | 4.0 | 4.1 |
| 9 (Comparison) | Epoxy resin | $5 \times 10^{15}$ | 43 | 2.4 | 2.0 | 2.2 | 2.0 |
| 10 (Comparison) | Polystyrene | $5 \times 10^{17}$ | 45 | 2.4 | 2.1 | 2.3 | 1.9 |
| 11 (Comparison | Water (water content, 30%) | $5 \times 10^5$ | 56 | 3.2 | 2.3 | 2.1 | 4.0 |

It can be seen from the results shown in Table 2 that good printing can be performed when the surface inherent resistivity of the fabrics is within a certain range.

EXAMPLE 3

The procedure of Example 1 was repeated except that 70 parts of aliginic acid (a polymeric electrolyte), 30 parts of polyoxyethylene nonyl phenol ether (6 mols of ehtylene oxide; a noninoic surfactant of an alkyl phenol ether type), and 30 parts of polyvinyl alcohol (a water-soluble polymer) were used as a treating agent for the fabric either alone or as mixtures as shown in Table 3 with the concentration of the treating solution being adjusted so that the add-on amount of the treating agent became 2%. The color development and fixing of the dye onto the fabric were effected by steaming at 130°C for 30 minutes. The toner transfer ratio and back surface contamination of the fabric at the time of electrostatic transfer and the color development, the edge of the printed pattern and the fog of the dye after development and fixation were determined, and the results obtained are shown in Table 3. The results with a non-treated fabric are also shown in Table 3.

Table 3

| Run No. | Treating Agent | Surface Inherent Resistivity | Transfer Ratio | Fabric Back Surface Contamination | Color Development | Edge of Printed Pattern | Fog |
|---|---|---|---|---|---|---|---|
| | | (ohms) | (%) | | | | |
| 1 | Mixture of alginic acid and polyoxyethylene nonyl phenol ether | $2 \times 10^8$ | 87 | 4.7 | 4.6 | 4.5 | 4.5 |
| 2 | Mixture of alginic acid and polyvinyl alcohol | $3 \times 10^8$ | 86 | 4.7 | 4.6 | 4.5 | 4.5 |
| 3 | Aliginic acid | $5 \times 10^8$ | 83 | 4.5 | 4.3 | 4.3 | 4.5 |
| 4 | Polyoxyethylene nonyl phenol ether | $3 \times 10^9$ | 82 | 4.6 | 4.4 | 4.5 | 4.4 |
| 5 | Polyvinyl alcohol | $1 \times 10^{10}$ | 80 | 4.4 | 4.3 | 4.3 | 4.4 |
| 6 (Comparison) | None | $5 \times 10^{16}$ | 48 | 2.4 | 2.2 | 2.5 | 2.6 |

As is clear from the results in Table 3, a combination of the polymeric electrolyte with the nonionic surfactant or the water-soluble polymer is especially suitable.

EXAMPLE 4

The procedure of Example 3 was repeated except that 50 parts of polyoxyethylene lauryl ether (5 mols of ethylene oxide; a nonionic surfactant of a higher fatty alcohol ether type) and 50 parts of polyethylene glycol (average molecular weight 600; water-soluble polymer) were used either alone or as a mixture as shown in Table 4 as a treating agent for the fabric. The results obtained are shown in Table 4. The results obtained with a non-treated fabric are also shown in Table 4.

Table 4

| Run No. | Treating Agent | Surface Inherent Resistivity | Transfer Ratio | Fabric Back Surface Contamination | Color Development | Edge of Printed Pattern | Fog |
|---|---|---|---|---|---|---|---|
| | | (ohms) | (%) | | | | |
| 1 | Polyoxyethylene lauryl ether + polyethylene glycol | $1 \times 10^9$ | 89 | 4.7 | 4.7 | 4.6 | 4.6 |
| 2 | Polyoxyethylene lauryl ether | $5 \times 10^9$ | 82 | 4.5 | 4.4 | 4.4 | 4.4 |
| 3 | Polyethylene glycol | $3 \times 10^{10}$ | 80 | 4.3 | 4.3 | 4.3 | 4.3 |
| 4 (Comparison) | None | $5 \times 10^{16}$ | 48 | 2.4 | 2.2 | 2.5 | 2.6 |

It can be seen from the results in Table 4 that the use of the nonionic surface active agent and the water-soluble polymer in combination provides especially good results.

EXAMPLE 5

The procedure of Example 1 was repeated except that polyoxyethylene nonyl phenol ether (ethylene oxide 6 mols) was used as a treating agent for the fabric, the concentration of the treating solution was changed so that the add-on amount was as shown in Table 5, the squeeze ratio was 100%, and the color development and fixation of the dye to the fabric were performed by steaming at 130° for 30 minutes.

The toner transfer ratio and back surface contamination of these fabrics at the time of electrostatic transfer, and the color development, the edge of the printed pattern and the fog after the color development and fixation of the dye were determined, and the results obtained are shown in Table 5. The results obtained with a non-treated fabric are also shown in Table 5. The toner transfer was carried out in an atmosphere kept at 20° C and an RH of 45%.

Table 5

| Run No. | Pick-up | Surface Inherent Resistivity | Transfer Ratio | Fabric Back Surface Contamination | Color Development | Edge of Printed Pattern | Fog |
|---|---|---|---|---|---|---|---|
| | (%) | (ohms) | (%) | | | | |
| 1 | 0.05 | $1 \times 10^{14}$ | 61 | 4.0 | 3.2 | 3.8 | 3.9 |
| 2 | 0.10 | $2 \times 10^{13}$ | 78 | 4.2 | 4.1 | 4.0 | 4.0 |
| 3 | 0.50 | $5 \times 10^{11}$ | 82 | 4.3 | 4.3 | 4.3 | 4.3 |
| 4 | 1.00 | $2 \times 10^{11}$ | 84 | 4.5 | 4.5 | 4.2 | 4.5 |
| 5 | 3.00 | $9 \times 10^{10}$ | 83 | 4.5 | 4.6 | 4.5 | 4.3 |
| 6 | 5.00 | $7 \times 10^{10}$ | 85 | 4.6 | 4.6 | 4.3 | 4.2 |
| 7 | 10.00 | $5 \times 10^{10}$ | 86 | 4.6 | 4.5 | 4.1 | 4.5 |
| 8 | 20.00 | $4 \times 10^{10}$ | 85 | 4.5 | 4.6 | 4.4 | 4.3 |
| 9 (Comparison) | 0 | $1 \times 10^{16}$ | 51 | 2.3 | 2.2 | 2.5 | 2.5 |

It can be seen from the results in Table 5 that the effect of preventing fabric back surface contamination is observed with the add-on amount of 0.05%, and when the add-on amount is 0.1%, quite satisfactory printing for practical purposes is achieved.

parts of each of the antistatic agents shown in Table 7. The results obtained in Table 7.

For comparison, the above procedures were repeated except that a polyester taffeta fabric which did not contain an antistatic agent was used. The results obtained are also shown in Table 7.

Table 7

| Run No. | Antistatic Agent | Surface Inherent Resistivity | Transfer Ratio | Fabric Back Surface Contamination | Color Development | Edge of Printed Pattern | Fog |
|---|---|---|---|---|---|---|---|
| | | (ohms) | (%) | | | | |
| 1 | Adduct of ethylene diamine with 5 mols of ethylene oxide | $2 \times 10^{12}$ | 80 | 4.1 | 4.3 | 4.4 | 4.1 |
| 2 | Adduct of Polyethylene glycol with 7 mols of ethylene oxide | $5 \times 10^{12}$ | 82 | 4.0 | 4.2 | 4.3 | 4.1 |
| 3 | Didodecyl dipropyl ammonium bromide | $3 \times 10^{11}$ | 83 | 4.1 | 4.2 | 4.5 | 4.3 |
| 4 (Comparison) | None | $5 \times 10^{16}$ | 52 | 1.9 | 2.6 | 2.8 | 2.0 |

EXAMPLE 6

Procion Brilliant Blue H7GS (tradename for a reactive dyestuff, a product of Imperial Chemical Industries) was used as a dye for a toner, and a cotton broad cloth fabric with a thickness of about 0.5 mm was used. The treating agent for the fabric was a mixture of a 1% aqueous solution of polyethylene glycol monooleate (a nonionic surfactant) to which 10% of urea and 3% of sodium carbonate were added so as to develop the color of the reactive dye. The relative humidity of the atmosphere at the time of electrostatic transfer was varied as shown in Table 6, and the color development and fixation of the dye were performed by steaming at 110°C for 30 minutes. Otherwise, the same procedures as in Example 1 were followed. The results obtained are shown in Table 6. The fabric treated had a surface inherent resistivity of $1 \times 10^9$ ohms.

Table 6

| Run No. | Relative Humidity of Atmosphere | Transfer Ratio | Fabric Back Surface Contamination | Color Development | Edge of Printed Pattern | Fog |
|---|---|---|---|---|---|---|
| | (%) | (%) | | | | |
| 1 | 85 | 86 | 4.5 | 4.5 | 4.0 | 4.3 |
| 2 | 70 | 87 | 4.7 | 4.6 | 4.3 | 4.3 |
| 3 | 55 | 84 | 4.6 | 4.4 | 4.2 | 4.4 |
| 4 | 40 | 80 | 4.4 | 4.3 | 4.0 | 4.1 |
| 5 | 25 | 74 | 4.0 | 4.1 | 4.1 | 4.1 |

It can be seen from the results in Table 6 that when the humidity of the atmosphere is low, the effect is reduced, and generally, the relative humidity should be at least 30%, preferably at least 50%.

EXAMPLE 7

The procedures of Example 1 were repeated except that a polyester taffeta fabric having a thickness of about 0.2 mm was used which was produced from polyester fibers prepared from 100 parts of polyester and 2

EXAMPLE 8

The procedures of Run No. 2 of Example 1 were repeated except that the transfer was carried out by overlaying the fabric on the developed surface of the photosensitive paper and an electrically conducting roller impressed with a voltage of −1000 V was rolled over the surface of the fabric at a pressure of about 1 Kg/cm² to transfer the toner to the fabric. The results obtained are shown in Table 8. Table 8 also contains the results obtained with a non-treated fabric. The transfer of the toner was effected in an atmosphere held at a temperature of 15° C and a relative humidity of 70%.

Table 8

| Run No. | Transfer Ratio | Fabric Back Surface Contamination | Color Development | Edge of Printed Pattern | Fog |
|---|---|---|---|---|---|
| | (%) | | | | |
| 1 | 83 | 4.1 | 4.1 | 4.2 | 4.3 |
| 2 (Comparison) | 51 | 2.8 | 2.7 | 2.4 | 2.6 |

These results show that the process of this invention is also effective for transfer in accordance with a bias roll method.

EXAMPLE 9

The procedures of Example 1 were repeated except that polyacrylamide was used as a treating agent for the fabric (the surface inherent resistivity of the fabric was $1 \times 10^{12}$ ohms), and that in the electrostatic transfer of the toner to the fabric, the fabric was overlaid on the developed surface of the photosensitive paper, a sheet of rice paper was further laid on top of it, and corona discharge was applied to the assembly from the side adjacent the rice paper. The results obtained are shown in Table 9. For comparison, the above procedures were repeated except that the rice paper was not used. The results obtained are also shown in Table 9.

Table 9

| Run No. | Add on | Rice paper | Transfer Ratio | Fabric Back Surface Contamination | Color Development | Edge of Printed Pattern | Fog |
|---|---|---|---|---|---|---|---|
| | | | (%) | | | | |
| 1 | Yes | Yes | 80 | 4.2 | 4.1 | 4.3 | 4.5 |
| 2 | Yes | No | 84 | 4.5 | 4.4 | 4.3 | 4.3 |
| 3 (Comparison) | No | No | 47 | 2.4 | 2.1 | 2.5 | 2.6 |

The results show that the effect increases when corona discharge is carried out through a sheet overlaid on the fabric.

EXAMPLE 10

An amorphous selenium photosensitive plate was uniformly charged positively with a corona discharge of 6000 V, and exposed through a black and white film having an image of a circular spot-like design to form an electrostatic latent image of the spot-like design.

On the other hand, 150 parts of polystyrene was dissolved in 1000 parts of benzene, and 50 parts of Dianix Red Fb (a disperse dye, a tradename for a product of Mitsubishi Chemical Co., Ltd.) was added. These materials were uniformly mixed, and poured into a large quantity of water, followed by drying and sieving of the precipitate to obtain a powdery toner having a particle size of 15 to 25 microns. The toner was mixed with glass balls and stirred. Using this toner, the above latent image was developed using a cascade method to form a toner image of the circular spot-like design.

On the other hand, a woven fabric of polyester textured yarns having a thickness of about 0.8 mm was dipped in a 2% aqueous solution of lauryl dimethyl betaine (amphoteric surfactant), and then squeezed with a mangle at a squeeze ratio of 100%, followed by drying ina dryer at 100° C for 10 minutes. The fabric has a surface inherent resistivity of $2 \times 10^8$ ohms.

The fabric so treated was overlaid on the developed surface of the photosensitive plate, and a corona discharge of +6500 V was applied to the assembly from the back side of the fabric to transfer the toner image on the photosensitive plate to the fabric.

The fabric having the toner transferred thereto was then exposed to a trichloroethylene vapor for about 10 seconds to fix the toner onto the fabric, and steamed at 130° C. for 30 minutes to develop the color of the dye and fix the dye. Then, the fabric was washed with trichloroethylene to remove the resin.

The results obtained are shown in Table 10.

For comparison, the above procedures were repeated except that the fabric was not treated. The results obtained are also shown in Table 10.

Table 10

| Run No. | Transfer Ratio | Fabric Back Surface Contamination | Color Development | Edge of Printed Pattern | Fog |
|---|---|---|---|---|---|
| | (%) | | | | |
| 1 | 80 | 4.4 | 4.0 | 4.1 | 4.3 |
| 2 (Comparison) | 43 | 2.8 | 2.3 | 2.1 | 2.1 |

These results show that the process of this invention is effective also in a so-called cascade method.

EXAMPLE 11

A polyethylene sheet having a thickness of about 0.2 mm was overlaid on a selenium photosensitive plate on which a latent image of a flower design charged positively was formed, and a corona discharge of −8000 V was applied to the assembly from above the polyethylene sheet. The sheet was separated from the photosensitive plate, and the negative charge on the polyethylene sheet was erased by wiping the sheet with a moistened cloth, and a positively charged latent image in a mirror image relation with the latent image on the photosensitive plate was transferred onto the polyethylene sheet. The resulting latent image on the polyethylene sheet was developed using the toner as described in Example 8 in the same manner as in Example 8. Then, the same treatment as in Example 8 was carried out. The results obtained are shown in Table 11.

For comparison, the same procedures as described above were repeated except that the fabric was not treated. The results obtained are also shown in Table 11.

Table 11

| Run No. | Transfer Ratio | Fabric Back Surface Contamination | Color Development | Edge of Printed Pattern | Fog |
|---|---|---|---|---|---|
| | (%) | | | | |
| 1 | 81 | 4.2 | 4.0 | 4.0 | 4.3 |
| 2 (Comparison) | 53 | 2.7 | 2.1 | 2.0 | 2.5 |

EXAMPLE 12

A photoconductive layer of cadmium sulfide (CdS) was formed on an aluminum sheet, and an insulating film of polyethylene terephthalate was laminated on the sheet in close contact. A corona discharge of 6000 V was applied to the insulating film surface of the resulting photosensitive plate to charge the surface positively all over. The photosensitive plate was exposed for 0.3 second through a black and white film with a flower design image using a 20 lux tungstenfilament lamp, and at the same time, an alternate current corona discharge of 6000 V was applied to the plate. Then, the entire surface was exposed for 2 seconds using a 30 lux tungsten-filament lamp to form an electrostatic latent image.

The latent image was developed using the same magentic brush method as described in Example 11 with the same toner as described in Example 10 to form a toner image of the flower design. A corona discharge of 6000 V was applied to the developed surface of the photosensitve plate, and a polyester satin treated in the same manner as in Run No. 1 of Example 1 was overlaid on the charged surface. A grounded semi-conductive rubber roller was rolled over the fabric and pressing against the fabric to transfer the toner to the fabric.

The fabric having the toner transferred thereto was then treated in the same manner as in Example 2 to fix the toner, develop the color of the dye and remove the resin.

The transfer ratio was 82%. The printed fabric exhibited a fabric back surface contamination of 4.5, a color development of 4.3, a printed pattern edge of 4.2 and a fog of 4.2.

EXAMPLE 13

A photosensitive paper with a photoconductive layer of zinc oxide was uniformly charged negatively in the dark with a corona discharge of 7000 V, and then exposed through a black and white film having an image of a flower design to form a corresponding electrostatic latent image on the photosenstive paper. On the other hand, 180 parts of an amino-modified polystyrene resin obtained by reacting a styrene-glycidyl methacrylate copolymer with diethylamine was dissolved in 1000 parts of toluene, and 50 parts of Sumikalon Violet RL (a disperse dye, a tradename for a product of Sumitomo Chemical Co., Ltd.) was added. They were sufficiently dispersed uniformly, and with stirring, and the resulting dispersion was poured into a large quantity of water. The particles were then dried and sieved to form a powdery toner with a particle size of about 15 microns. 3 parts of the toner was mixed with 97 parts of iron powder and well stirred. Using the resulting mixture, the latent image was developed using a magnet brush method.

A polyester taffeta fabric having a thickness of about 0.15 mm was overlaid on the developed surface of the photosensitive paper, and 1, 2 or 3 thick paper sheets with a thickness of about 0.6 mm (having a volume inherent resistivity of $1.1 \times 10^{12}$ ohms-cm and a dielectric constant of 4.3) was overlaid on top of the fabric. A corona discharge of −7000 V was applied to the assembly from the side of the thick paper sheets thereby to transfer the toner on the photosensitive paper to the polyester taffeta. The toner transfer ratio in each case is shown in Table 12.

The polyester taffeta fabric to which the toner had thus been transferred was exposed to trichloroethylene vapor for about 10 seconds to fix the toner to the fabric, and heated in a dryer at 200° C for 15 seconds to develop the color of the dye. The fabric was then washed with trichloroethylene to remove the resin.

The visual evaluations of the resulting polyester taffeta with the flower design printed thereon are shown in Table 12.

Table 12 also contains the results which were obtained when the same procedure as above was repeated except that a thick paper sheet was not used.

The transfer of the toner was carried out in an atmosphere held at a temperature of about 21° C and a relative humidity of 40%.

Table 12

| Run No. | Number of Thick Paper Sheets Overlaid | Transfer Ratio | Visual Evaluation of the Edge of the Printed Pattern |
|---|---|---|---|
| | | (%) | |
| 1 | 1 | 84 | 4.6 |
| 2 | 2 | 87 | 4.4 |
| 3 | 3 | 81 | 4.4 |
| 4 (Comparison) | None | 52 | 2.8 |

As can be seen from the results in Table 12, very good prints were obtained in accordance with the process of the invention, and the contamination of the non-image areas was greatly reduced.

On the other hand, the direct transfer of the toner was carried out while only a half of the fabric surface was covered with one thick paper sheet. The resulting printed fabric was photographed and the photo is attached to the present application as the FIGURE. In the FIGURE, the left half corresponds to Run No. 1, and the right half, to Run No. 4. From this photo, the effect of the process of this invention can be clearly seen.

EXAMPLE 14

140 parts of the same resin as used in Example 13 and 40 parts of Diacotton Violet X (a direct dye, a tradename for a product of Mitsubishi Chemical Co., Ltd.) were dissolved and dispersed in 1000 parts of methyl ethyl ketone. The dispersion was spray-dried and the particles sieved to obtain a powdery toner having a particle size of about 10 to 20 microns.

Using the resulting toner, a latent image of a circular spot-like design on a photosensitive paper with a photoconductive layer of zinc oxide was developed. The latent image had been obtained by uniformly charging the photosensitive paper negatively, and exposing it through a black and white film with an image of the circular spot-like design.

A cotton broad cloth fabric with a thickness of about 0.5 mm was overlaid on the developed surface of the photosensitive paper, and a sheet of rice paper with a thickness of 0.2 mm whose moisture content was adjusted to the various humidities shown in Table 13 was overlaid on the cloth. A corona discharge of −6500 V was applied to the assembly from the side of the rice paper to transfer the toner to the cloth. The transfer ratio in each case is shown in Table 13.

The cloth to which the toner had been transferred was heated for about 5 seconds using an infrared lamp to fix the toner, and then steamed at 120° C for 30 minutes. After the color development and fixation, the cloth was washed with trichloroethylene to remove the resin. The visual evaluation of the edge of the printed pattern in the printed cloth is shown in Table 13.

Table 13 also contains the results obtained when the above procedure was repeated without using the rice paper.

The transfer of the toner was effected in an atmosphere held at a temperature of about 15° C and a relative humidity of 30%.

Table 13

| Run No. | Moisture Content of Rice Paper | Straw Paper Volume Inherent Resistivity | Straw Paper Dielectric Constant | Transfer Ratio | Visual Evaluation of the Edge of Printed Pattern |
|---|---|---|---|---|---|
| | (%) | (ohms-cm) | | (%) | |
| 1 | 40 | $8.1 \times 10^{13}$ | 3.2 | 88 | 4.6 |
| 2 | 55 | $9.3 \times 10^{11}$ | 4.1 | 87 | 4.6 |
| 3 | 70 | $2.6 \times 10^{10}$ | 9.5 | 89 | 4.6 |
| 4 | 85 | $5.5 \times 10^{8}$ | 23 | 86 | 4.6 |
| 5 | 95 | $5.0 \times 10^{6}$ | 45 | 81 | 4.2 |
| 6 (Comparison) | None | — | — | 49 | 2.4 |

It can be seen from the results in Table 13 that when a smooth sheet which is a dielectric material and is hygroscopic is used, good results are obtained with any degree of moisture content. However, better results are obtaind when the paper sheet is dry and has a high volume inherent resistivity. In every case, scarcely no contamination of the non-image areas was observed.

EXAMPLE 15

A latent image of a flower design on a photosensitive paper with a photoconductive layer of zinc oxide was developed with a toner having a particle size of 10 to 20 microns and comprising polystyrene and Suminol Fast Orange RG (a tradename of an acid dye, a product of Sumitomo Chemical Co., Ltd.) and and oleic acid as a charge controlling agent. Then, a nylon tricot fabric having a thickness of about 0.3 mm was overlaid on the developed surface of the photosensitive paper, and on top of the insulating film, a polyethylene sheet having a thickness of about 0.2 mm (having a volume inherent resistivity of $2.1 \times 10^{16}$ ohms-cm and a dielectric constant of 2.2) was overlaid. A corona discharge of −5500 V was applied to the assembly from the side of the polyethylene sheet to transfer the toner to the nylon tricot fabric. The transfer ratio is shown in Table 14. Then, the nylon tricot fabric was exposed to trichloroethylene vapor to fix the toner, steamed at 100° C for 20 minutes, and then washed with trichloroethylene to remove the resin. The visual evaluation of the edge of the printed pattern on the nylon tricot fabric is shown in Table 14.

In the above procedure, each of a polypropylene sheet having a thickness of about 30 microns (having a volume inherent resistivity of $3.0 \times 10^{16}$ ohms-cm and a dielectric constant of 2.0), a nylon sheet having a thickness of about 0.3mm (having a volume inherent resistivity of $5.4 \times 10^{12}$ ohms-cm, and a dielectric constant of 9.1) and an aluminum foil having a thickness of about 0.1 mm (having a volume inherent resistivity of $1.8 \times 10^{-}$ohms-cm) was used instead of the polyethylene sheet and overlaid on the nylon tricot fabric in contact with the fabric. Also, the aluminum foil was overlaid on the nylon tricot fabric but separated from the fabric by placing a polyethylene sheet with a thickness of about 0.3 mm at the four corners of the aluminum foil. The results obtained in these cases are also shown in Table 14.

For comparison, no sheet was overlaid on the fabric. The results are also shown in Table 14. The transfer of the toner was effected in an atmosphere held at a temperature of 18° C. and a relative humidity of 35%.

Table 14

| Run No. | Sheet | Transfer Ratio | Visual Evaluation of the Edge of the Printed Pattern |
|---|---|---|---|
| | | (%) | |
| 1 | Polyethylene | 85 | 4.4 |
| 2 | Polypropylene | 88 | 4.6 |
| 3 | Nylon | 83 | 4.4 |
| 4 | Aluminum (in contact) | 80 | 4.0 |
| 5 | Aluminum (with a separation) | 79 | 4.0 |
| 6 (Comparison) | None | 55 | 2.2 |

It can be seen from the results in Table 14 that sharp prints of high color density can be obtained using any of the above-mentioned sheets, and scarcely no contamination of the non-image areas was observed.

EXAMPLE 16

An amorphous selenium photosensitive plate was uniformly charged positively with a corona discharge of 6000 V, and exposed through a black and white film with an image of a circular spot-like design to form an electrostatic latent image corresponding to the spot-like design. On the other hand, 150 parts of polystyrene was dissolved in 1000 parts of benzene, and 50 parts of Dianix Red FB (a disperse dye, a tradename for a product of Mitsubishi Chemical Co., Ltd.) was uniformly dispersed in the solution. The resulting dispersion was poured into a large quantity of water. The precipitate was dried and sieved to form a toner having an average particle size of 15 to 25 microns. The toner was mixed with glass balls and stirred. Using this toner, the above latent image was developed using cascade method to form a toner image of the circular design.

A woven fabric of polyester textured yarns and having a thickness of about 0.4 mm was overlaid on the developed surface of the photosensitive plate, and on top of the fabric, a polyvinyl chloride film having a thickness of about 0.15 mm (having a volume inherent resistivity of $5.2 \times 10^{12}$ ohms-cm and a dielectric constant of 7.5) was overlaid. A corona discharge of 6000 V was applied to the assembly from the side of the film to transfer the toner image to the fabric. The toner transfer ratio was 85%. The fabric was heated with an infrared lamp to fix the toner onto the fabric, and then treated in the same manner as in Example 13 to develop the color of the dye and fix it, and remove the resin. Furthermore, the fabric was dipped in a 0.2% aqueous solution of thiourea dioxide at 80° C for 10 minutes to reduce and wash it, and then the fabric was washed with water and dried to form a printed fabric with a red circular spot-like design fixed thereto. The edge of the printed pattern of this fabric was evaluated as 4.2. Scarcely no contamination by fog of the white background other than the spot-like design was observed, and the fabric retained a high degree of whiteness in these non-image areas.

For comparison, the above procedure was repeated except that the polyvinyl chloride film was not used. The transfer ratio was 49%, and the edge of the printed pattern was evaluated as 2.4. Scarcely no contamination of the non-image areas was observed.

The transfer of the toner was carried out in all cases in an atmosphere held at a temperature of about 20° C and a relative humidity of 65%.

EXAMPLE 17

The procedure of Example 13 was repeated except that a toner having an average particle size of 5 to 15 microns and containing carbon black as a colorant was used, and instead of the thick paper, a polyurethane sheet having a thickness of about 0.5 mm (having a volume inherent resistivity of $2.1 \times 10^{11}$ ohms-cm and a dielectric constant of 6.7) or a natural rubber sheet having a thickness of about 1 mm (having a volume inherent resistivity of $1.5 \times 10^{15}$ ohms-cm and a dielectric constant of 2.9) was used. The results obtained are shown in Table 15. In this case, the color development of the dye and the removal of the resin after the transfer were not effected.

For comparison, the results obtained without the use of the polyurethane sheet or the natural rubber sheet are also shown in Table 15.

The transfer was carried out in an atmosphere held at a temperature of about 5° C and a relative humidity of 30%.

Table 15

| Run No. | Sheet | Transfer Ratio (%) | Visual Evaluation of the Edge of the Printed Pattern |
|---|---|---|---|
| 1 | Polyurethane sheet | 80 | 4.4 |
| 2 | Natural rubber sheet | 85 | 4.4 |
| 3 (Comparison) | None | 51 | 2.6 |

It can be seen from the results in Table 15 that good results are obtained also when smooth sheets of rubber are used.

EXAMPLE 18

A polyethylene sheet having a thickness of about 0.2 mm was overlaid on a selenium photosensitve plate on which a latent image of a flower design positively charged had been formed, and a corona discharge of −8000 V was applied to the assembly from the side of the polyethylene sheet. Then, the polyethylene sheet was separated from the photosensitive plate, and the negative charge of the polyethylene sheet was erased by wiping the sheet with a moistened cloth. A positively charged latent image having a mirror image relation with the latent image on the photosensitive plate was transferred to the polyethylene sheet. The latent image on the polyethylene sheet was developed with the same toner as described in Example 16 in the same manner as in Example 16, and then treatd in the same manner as in Example 16. Thus, when a polyvinyl chloride film was used at the time of toner transfer, the toner transfer ratio was 80%, and the edge of the printed pattern was evaluated as 4.0.

For comparison, the polyvinyl chloride film was not used in the above procedure. The toner transfer ratio was 53%, and the edge of the printed pattern was evaluated as 2.0.

The toner transfer was effected in an atmosphere held at a temperature of about 20° C and a relative humidity of 40%.

EXAMPLE 19

A photoconductive layer of cadmium sulfide (CdS) was formed on an aluminum sheet, and an insulating film of polyethylene terephthalate was laminated on the sheet in close contact with the sheet. A corona discharge of 6000 V was applied to the insulating film surface of the resulting photosensitive plate to charge the plate positively all over. Th photosensitive plate was exposed for 0.2 second through a black and white film with an image a flower design using a 20 lux tungsten-filament lamp, and at the same time, an alternate corona discharge of −6000 V was applied to the insulating film. Then, the entire surface was exposed for 1 second using a 30 lux tungsten-filament lamp to form an electrostatic latent image.

On the other hand, 100 parts of the same resin as described in Example 13 was dissolved in 1000 parts of trichloroethylene, and 5 parts of phthalocyanine blue (organic pigment) was dispersed in the solution. The dispersion was spray-dried, and the particles sieved to obtain a powdery toner having an average particle size of 10 to 25 microns. Using this toner, the above latent image was developed in the same manner as in Example 13.

A polyester/cotton mixed woven fabric having a thickness of about 0.5 mm was overlaid on the developed surface of the photosensitive plate, and on top of the fabric, two thick paper sheets as described in Run No. 2 in Example 13 were superimposed. A corona discharge of −7000 V was applied to the assembly from the side of the thick paper sheets to transfer the toner to the fabric. The fabric was then heated for 5 seconds using an infrared lamp to fix the toner to the fabric. The toner transfer ratio was 86%, and the edge of the printed pattern was evaluated as 4.6.

While the invention has been described in detail and with reference to specific embodiments thereof, it will be apparent to one skilled in the art that various changes and modifications can be made therein without departing from the spirit and scope thereof.

What is claimed is:

1. A process for electrostatically printing a design on fabrics which comprises forming an electrostatic latent image corresponding to the design on a photoconductive material or an insulating dielectric material, developing the latent image with a toner comprising at least one chargeable resin and at least one colorant, transferring the developed toner image directly to a fabric having a surface inherent resistivity, as measured at a temperature of 20° C and a relative humidity of 65%, of about $1 \times 10^6$ to about $1 \times 10^{14}$ ohms, and fixing the toner image to the fabric.

2. The process of claim 1, wherein the surface inherent resistivity is achieved by previously treating the fabric with a treating agent to adjust the surface inherent resistivity of the fabric to about $1 \times 10^6$ to about $1 \times 10^{14}$ ohms.

3. The process of claim 2, wherein said treating agent is selected from the group consisting of a water-soluble polymer, and an inorganic material.

4. The process of claim 3, wherein said water-soluble polymer is selected from the group consisting of carboxymethyl cellulose, hydroxyethyl cellulose, polyvinyl alcohol, polyvinyl pyrrolidone, polyacrylamide and polyethylene oxide.

5. The process of claim 3, wherein said inorganic material is selected from the group consisting of an alkali metal salts, an alkaline earth metal salt, an alkali metal hydroxide, an alkaline earth metal oxide and a metal powder.

6. The process of claim 2, wherein said treating agent is selected from the group consisting of a nonionic surface active agent, an anionic surface active agent, a cationic surface active agent, an amphoteric surface active agent, and a water-soluble polymeric electrolyte selected from the group consisting of polyacrylic acid, polystyrenesulfonic acid, polyvinylsulfonic acid, polyphosphoric acid, polyvinylamine, polyethyleneimine, nucleic acid and alginic acid.

7. The process of claim 6, wherein said nonionic surface active agent is selected from the group consisting of an alkylphenol ether surfactant, a higher fatty alcohol ether surfactant, a higher fatty acid sorbitan ester surfactant, a higher fatty acid pentaerythritol ester surfactant, a higher fatty acid trimethylol propane ester surfactant, a higher fatty acid polyethylene glycol ester sufactant and a nitrogen-containing surfactant.

8. The process of claim 6, wherein said anionic surface active agent is selected from the group consisting of a higher alcohol sulfuric acid ester salt and a alkylbenzenesulfonic acid salt.

9. The process of claim 6, wherein said cationic surface active agent is selected from the group consisting of a polyoxyethylene alkylamine and a quanternary ammonium salt.

10. The process of claim 6, wherein said amphoteric surface active agent is selected from the group consisting of a betaine surfactant and an amino acid surfactant.

11. The process of claim 2, wherein said treating agent comprises a combination of a polymeric electrolyte with a nonionic surfactant or a water-soluble polymer.

12. The process of claim 2, wherein said treating agent comprises a combination of a nonionic surfactant and a water-soluble polymer.

13. The process of claim 2, wherein said treating agent is selected from the group consisting of carboxymethyl cellulose, hydroxyethyl cellulose, polyethylene oxide, an ether nonionic surfactant, an ester nonionic surfactant, polyacrylic acid, a sodium salt of polyacrylic acid, polyalginic acid, and a sodium salt of polyalginic acid.

14. The process of claim 2, wherein the treating of the fabric with the treating agent comprises dipping the fabric in a solution or dispersion of the treating agent, or spraying or coating the solution or dispersion of the treating agent of the fabric whereby the the add-on percentage of said treating agent is about 0.01 to about 20% of said treating agent.

15. The process of claim 1, wherein said fabric comprises a synthetic fiber, and said surface inherent resistivity is achieved by incorporating a treating agent in a spinning solution of a polymer from which said fibers are prepared, or into a polymer from which said fibers are prepared.

16. The process of claim 15, wherein the amount of the treating agent is about 0.2 to about 25% by weight based on the weight of the polymer.

17. The process of claim 1, wherein the electrostatically transferring of the toner image to the fabric is by applying a corona discharge of about 3,000 to 10,000 V for about 20 seconds or less.

18. The process of claim 1, wherein the electrostatically transferring of the toner image to the fabric is employing a bias roller method using a roller to which a voltage of about 300 to about 1500 V is applied under a pressure of about 0.05 to about 1 $Kg/cm^2$.

19. The process of claim 1, wherein the electrostatically transferring of the toner image is in an atmosphere at a relative humidity of at least about 30%.

20. The process of claim 1, wherein the fixing of the toner image to the fabric is by heating the fabric or exposing the fabric to a solvent vapor.

21. The process of claim 1, including washing the printed fabric after fixing with a solvent.

22. A process for electrostatically printing a design on fabrics which comprises forming an electrostatic latent image corresponding to the design on a photoconductive material or an insulating dielectric material, developing the latent image with a toner comprising at least one chargeable resin and at least one colorant, overlaying a fabric on the developed surface of said material and transferring the developed toner image directly to the fabric by overlaying a smooth sheet having a volume inherent resistivity of about $1 \times 10^6$ to about $1 \times 10^{20}$ ohms and a dielectric constant of about 2 to about 40 on that surface of the fabric which is opposite the surface of the fabric to be imprinted, and applying a corona discharge to the assembly from the side of the smooth sheet, and fixing the toner image to the fabric.

23. The process of claim 22, wherein said smooth sheet has a volume inherent resistivity of $1 \times 10^9$ to $1 \times 10^{17}$ ohms.

24. The process of claim 22, wherein the thickness of the smooth sheet is about 10 microns to about 5 millimeters.

25. The process of claim 22, wherein said smooth sheet is selected from the group consisting of a paper sheet, a resin-impregnated paper sheet, a waterproofed paper sheet, a film or sheet of synthetic resin or a natrual or synthetic rubber, a synthetic paper-like web or a non-woven fabric, and a film or non-woven fabric of cellulose xanthate.

26. The process of claim 22, wherein the electrostatically transferring of the toner image is in an atmosphere at a relative humidity of at least about 30%.

27. The process of claim 22, wherein the fixing of the toner image to the fabric is by heating the fabric or exposing the fabric to a solvent vapor.

28. The process of claim 22, including washing the printed fabric after fixing with a solvent.

29. The process of claim 22, wherein said fabric is previously treated with a treating agent to adjust the surface inherent resistivity of the fabric measured at a temperature of 20° C and a relative humidity of 65% to about $1 \times 10^6$ to about $1 \times 10^{14}$ ohms.

* * * * *